US007331692B2

(12) United States Patent
Baiardi et al.

(10) Patent No.: US 7,331,692 B2
(45) Date of Patent: Feb. 19, 2008

(54) LIGHT BEAM PROJECTOR WITH FILTER SET ROTATING ON ITS OWN AXIS

(75) Inventors: Bruno Baiardi, Via Colli, 14, Felizzano (AL) (IT) I-15023; Giancarlo Reposio, Fubine (IT); Edoardo Versino, Felizzano (IT)

(73) Assignee: Bruno Baiardi, Felizzano (AL) (IT)

( * ) Notice: Subject to any disclaimer, the term of this patent is extended or adjusted under 35 U.S.C. 154(b) by 235 days.

(21) Appl. No.: 10/513,624

(22) PCT Filed: Apr. 23, 2003

(86) PCT No.: PCT/IB03/01527

§ 371 (c)(1),
(2), (4) Date: Jan. 5, 2005

(87) PCT Pub. No.: WO03/093725

PCT Pub. Date: Nov. 13, 2003

(65) Prior Publication Data

US 2005/0117348 A1 Jun. 2, 2005

(30) Foreign Application Priority Data

May 6, 2002 (IT) ..... TO2002A0371

(51) Int. Cl.
*F21V 17/02* (2006.01)

(52) U.S. Cl. ..... 362/322; 353/84

(58) Field of Classification Search ..... 362/319, 362/322; 353/84, 20
See application file for complete search history.

(56) References Cited

U.S. PATENT DOCUMENTS

| | | | | |
|---|---|---|---|---|
| 1,551,901 | A * | 9/1925 | Nase | 362/280 |
| 1,751,582 | A * | 3/1930 | Graslewicz | 362/277 |
| 1,824,894 | A * | 9/1931 | Hopkin, Jr. | 362/293 |
| 2,104,911 | A * | 1/1938 | Snyder | 340/480 |
| 2,273,026 | A * | 2/1942 | Dircksen | 340/815.68 |

(Continued)

FOREIGN PATENT DOCUMENTS

DE 3908148 A1 * 9/1990

(Continued)

*Primary Examiner*—Hargobind S. Sawhney
(74) *Attorney, Agent, or Firm*—Levine & Mandelbaum

(57) ABSTRACT

A light beam projector has a light source and a reflector arranged to have light generated by the light source converge into a light beam. The reflector has a hollow curved surface with a focal point where the light source is positioned, and a filter able to change the color of the light beam based on the angle of incidence of the beam on the filter. The filter has a plurality of filter elements arranged by sectors to form a diaphragm between the light source and the light beam outlet from the projector. In order to change the angle of incidence of the light beam on the filter elements, the sectors are able to rotate on their axes from a closed position, in which they fully intercept the light beam, to an open position, in which they do not intercept the light beam, as well as to all intermediate positions. The light beam projector has at least two filtering systems, one including at least one of the diaphragms, placed one after the other along the path of the light beam. Each sector forming the diaphragms can be rotated independently of the other sectors.

39 Claims, 6 Drawing Sheets

U.S. PATENT DOCUMENTS 2,338,078 A * 12/1943 Wood ..... 362/187
2,361,480 A * 10/1944 Joffo ..... 340/321
2,572,488 A * 10/1951 Jagersberger ..... 356/45
3,588,488 A * 6/1971 Lauterbach ..... 362/2
4,214,295 A * 7/1980 Morton ..... 362/164
4,984,143 A * 1/1991 Richardson ..... 362/293
5,183,328 A * 2/1993 Osteen ..... 362/294
5,186,536 A * 2/1993 Bornhorst et al. ..... 362/293
5,367,444 A * 11/1994 Bornhorst et al. ..... 362/264
5,398,058 A * 3/1995 Hattori ..... 348/224.1
5,515,119 A * 5/1996 Murdock et al. ..... 352/131
6,161,945 A * 12/2000 Baiardi ..... 362/277
6,267,478 B1 * 7/2001 Chen ..... 353/84
6,461,022 B1 * 10/2002 Kreutzer et al. ..... 362/293
6,572,246 B1 * 6/2003 Hopp et al. ..... 362/298
6,601,974 B1 * 8/2003 Hewlett et al. ..... 362/297
6,605,916 B1 * 8/2003 Yoshikawa ..... 318/602
6,817,737 B2 * 11/2004 Romano et al. ..... 362/293

FOREIGN PATENT DOCUMENTS

RU 2189952 C2 * 9/2002

* cited by examiner

LIGHT BEAM PROJECTOR WITH FILTER SET ROTATING ON ITS OWN AXIS

BACKGROUND OF THE INVENTION

The present invention refers to a light beam projector comprising a light source and a reflecting means, which are arranged for converging the light generated by the light source into a light beam, such reflecting means having a hollow curved surface and a focal point located where the light source is positioned, means for filtering the light beam, able to change its colour based on the angle of incidence of the beam on them, said filtering means comprising a plurality of filters arranged by sectors to form a diaphragm interposed between the light source and the light beam output from the projector, where said sectors, in order to change the angle of incidence of the light beam on the filters, can rotate on their own axis, to move from a closed position where they fully intercept the light beam, to an open position where such a light beam is not intercepted, as well as to all intermediate positions.

In particular, the present invention refers to light beam projectors for medium, high and very high lighting power.

According to the state of the art, several methods are known for changing the colour of the light beam emitted by a source of light. Many systems use coloured gel interposed in the light beam for changing its colour and, additionally, they make use of various mechanical techniques for changing different coloured gel associated to a single lighting device.

However, these systems have considerable drawbacks, since they do not ensure continuous colour corrections nor obtaining small changes to the above corrections.

Other recent systems have improved the system for changing the colour of the light beam, using dichroic filters instead of coloured gel.

These filters are formed by a plurality of layers, which may have a low or high refraction index, alternatively. According to the type and number of the layers of a filter, the latter takes a basic coloration, such as magenta, cyan, yellow, etc.

In the state of the art, it is also known that such dichroic filters have very peculiar features, since they operate on an interference principle, i.e. substantially separating two colours from a white light source, one of these colours being transferred and the other colour complementary to the first one, being reflected.

Moreover, changing the angle of incidence (reference is made to the patent U.S. Pat. No. 3,085,468) of a light beam with respect to a dichroic filter, the colour spectrum (i.e. the wavelength of the coloured light) transmitted through the filter can be changed, i.e. changing the colour of the light beam exiting the filter.

A problem frequently arising when using the above means for changing the colour of the light beam, in particular when high power systems are concerned, is caused by overheating of the equipment inside the lighting systems. Quite often, in fact, free air circulation is not allowed inside them; additionally, the light not being transmitted, i.e. reflected by the filters, will directly affect the lamp and other internal components of the equipment, overheating these components.

Another problem associated to the known systems is that only one colour shade of the light beam emitted by the system can be obtained each time. These systems, in fact, generally use diaphragms with dichroic filters, which are so arranged to be intercepted by a light beam, where the dichroic filters of each diaphragm have the same features and have all the same angle of rotation to the direction of the light beam.

This causes a certain rigidity in selecting the light that can be obtained from said known devices.

SUMMARY OF THE INVENTION

In this frame, it is the main object of the present invention to provide a light beam projector, which favours a continuous air circulation inside the projector itself, avoiding projector overheating through a correct positioning of the adjustable dichroic filters and obtaining, additionally, a light beam with various continuously variable simultaneous colorations.

In order to achieve such aims, it is the object of the present invention to provide a light beam projector incorporating the features of the annexed claims, which are integral part of the present description.

Further objects, features and advantages of the present invention will become apparent from the following detailed description and annexed drawings, which are supplied by way of non limiting example, wherein:

DESCRIPTION OF THE PREFERRED EMBODIMENT

Figure 1:
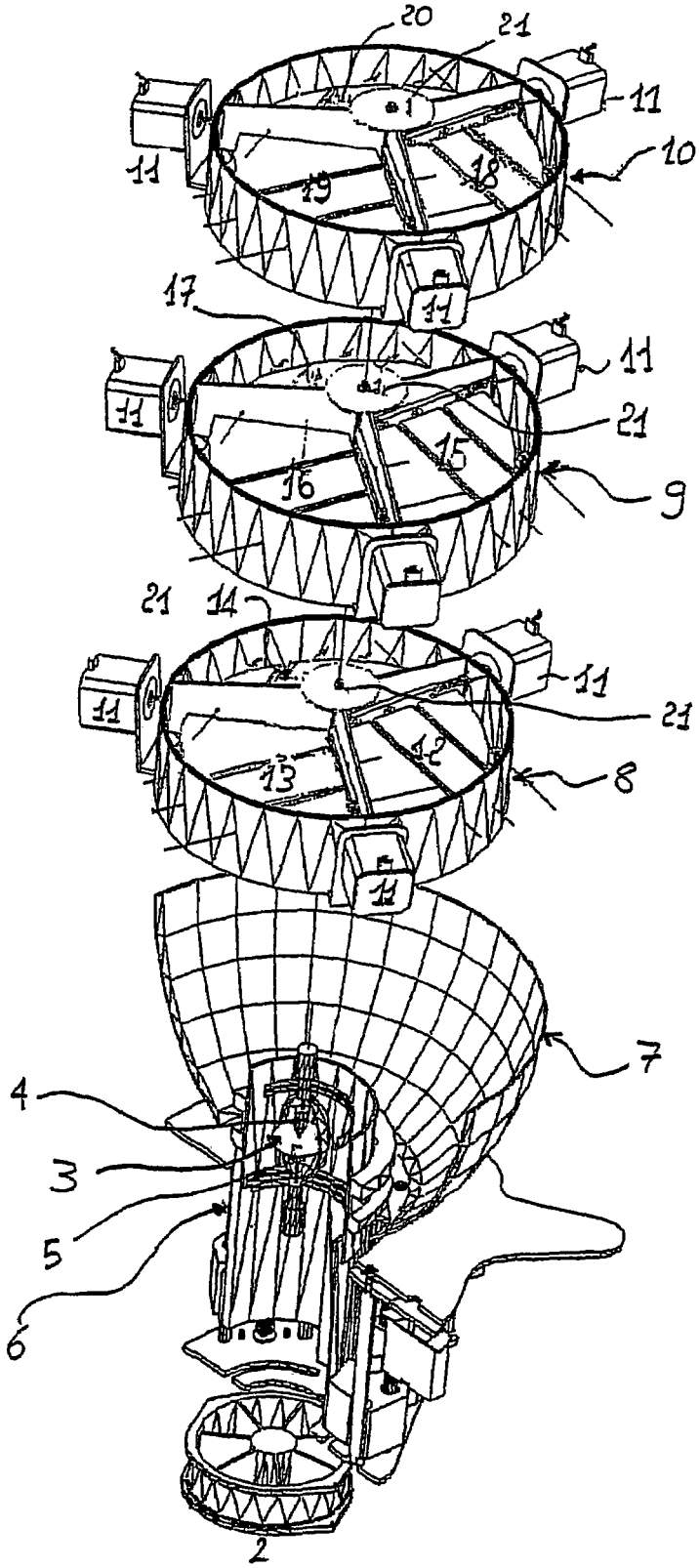
FIG. 1 shows a basic view of a light beam projector incorporating the features of the present invention.

Referring to the descriptions of the drawings, FIG. 1 is representing a light beam projector, which comprises as usual a light source consisting of a lamp 3 (which may have a short arc) with the electrodes 4 and 5, located substantially on the same axis.

The light produced by the lamp 3 is reflected by a parabola 7, which forms a reflecting surface producing a light beam with either a constant or diverging cross section.

According to the present invention, the projector comprises at least a tubular wall 6, whose axis matches substantially the axis of the parabola 7; when the wall is in its operating position, it will embrace and enclose the lamp 3 laterally; the tubular wall 6 may also take a rest position, in which case it is placed below the parabola 7, so as not to interfere with the light emitted by the light source, or it can be located in an intermediate position between the operating and rest positions, allowing different interference degrees with the light beam.

Moreover, the wall 6 may consist of different materials, which are provided for obtaining various scopes according to the specific material being used for its manufacture and/or machining.

It is known, for instance, how a sanding treatment of a glass surface may produce a plurality of concavities on the treated surface.

When this "frosted" tubular wall is placed in its operating position with respect to the light source, radiations are deviated by the small concavities and the light direction changed before reaching the parabola 7; when these diverted radiations are reflected by the parabola 7, a "frosted" diffused light is obtained.

Should a filter have a tubular wall 6 with different "frosting" degrees on various portions of its surface in the vertical direction, variable photometric features of the output light would be obtained according to its position around the lamp 3.

The tubular wall 6 may also be a steel tube (or opaque material) placed not too distant around the lamp 3; when the tube is completely enclosing the lamp, it will operate like a shutter and fully hinder the light from going through and be reflected by the parabola.

This shutter, which may be formed by fully closed or partially open portions (or totally opaque or partially opaque portions), operates like a damper or "mechanical dimmer", because it will let either major or minor light portions go through according to its position around the lamp.

A tubular wall 6 may also consist of just one filter submitted to a dichroic treatment ensuring one or more corrections for changing the colour temperature, i.e. attenuating determined colour temperature degrees before the light can hit the parabola 7 for back reflection.

In the instance of a lamp operating with 6500 Kelvin (K) degrees, should a filter be inserted for reducing its colour temperature by 2000 K in one filter portion and by 800 K in another filter portion, it would be possible for the equipment to reach various colour temperature degrees using only one lamp, depending on the filter portion interlaid between the lamp 3 and the parabola 7 (in the above example, the result would be: inserting a certain portion, the colour temperature would be: 6500 K−2000 K=4500 K. Moving the filter so as to interlay the other portion, which has undergone a dichroic treatment for reducing 800 K, the result would be: 6500 K−800 k=5700 K). Thus, the lights would be obtained with a different colour temperature suitable for various employment conditions, such as exterior lighting, interior lighting, and so on.

Moreover, a tubular wall 6 can undergo a dichroic treatment for obtaining several colorations in a vertical direction on the dichroic tube itself; thus, a plurality of different colorations of the resulting light beam may be obtained, depending on the wall portion being interlaid for intercepting the light emitted by the light source before being reflected by the parabola.

Obviously, the projector can be manufactured with a plurality of tubular walls 6 made from different materials and differently featured or in the various portions of the tubular wall itself, in order to obtain the results previously described according to the purposes to be reached, interposing the tubular wall made from the most appropriate material and/or machining between the light source and the reflecting means.

Anyway, since the tubular wall 6 is positioned at a short distance around the lamp, it will ensure free air flow between the wall and the lamp for the cooling of the lamp and whole equipment.

As it can be noticed in FIG. 1, a second portion of the light beam projector according to the present invention is also shown, in which a number of diaphragms 8, 9 and 10 are positioned, each one of them divided in three sectors 12, 13 and 14; 15, 16 and 17; 18, 19 and 20, respectively, and provided with adjustable dichroic filters, according to the present invention.

Figure 2:
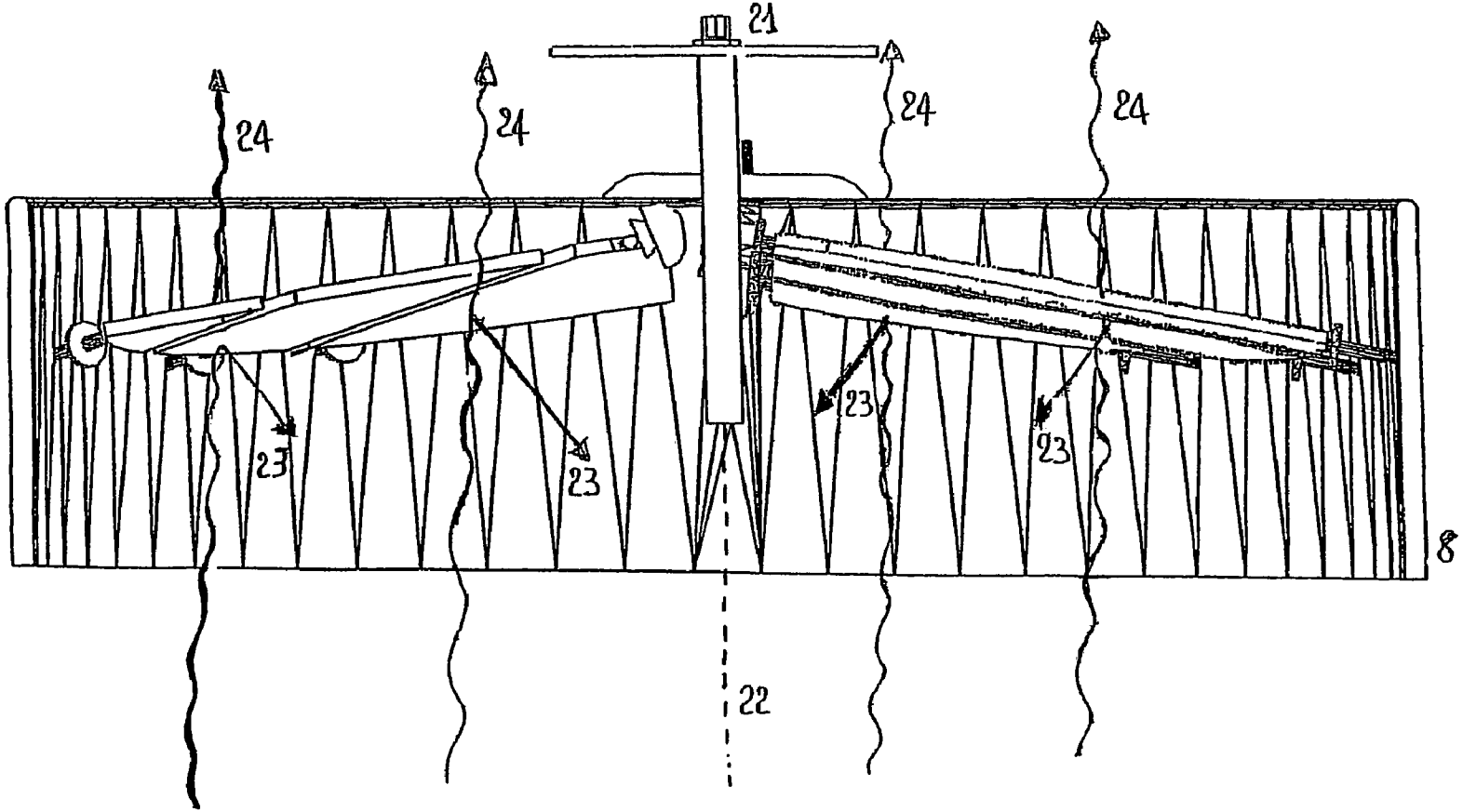
FIG. 2 shows a front section of a diaphragm fitted with flat filters.

As better detailed in FIG. 2, where the front section of one diaphragm is represented, each adjustable dichroic filter is preferably placed in a non perpendicular position to the axis of the light beam 22.

As mentioned above, dichroic filters operate according to an interference principle, i.e. substantially separating two colours from a white light source, one of these colours being transmitted and the other complementary to the first one, being reflected. Through the position of the dichroic filters of the present invention preferably not perpendicular to the light beam, the light ray complementary to the other ray 24 transmitted over the filter, i.e. the reflected ray 23, it not reflected again on the lamp 3 and other internal components of the lighting equipment, avoiding overheating.

Figure 3:
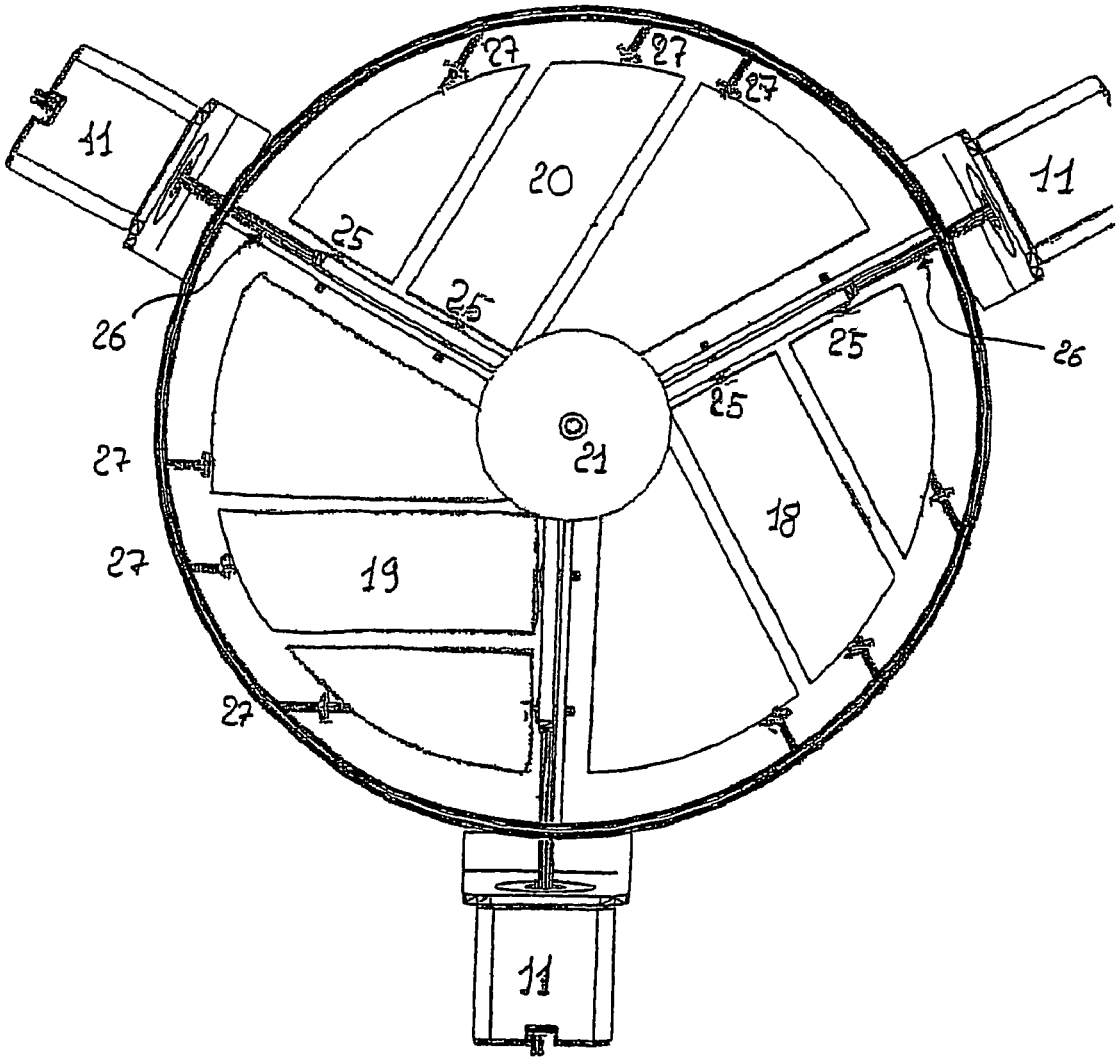
FIG. 3 shows a plan view of a diaphragm with flat filters divided in three sectors, each one of 120 degrees, which are positioned according to the features of the present invention.

With reference to the FIG. 3 describing any of the diaphragms 8; 9; 10 containing flat dichroic filters object of the present invention, it will be noticed how the filters are divided in three different sectors 12, 13 and 14; or 15, 16 and 17; or 18, 19 and 20, which occupy equal portions with respect to the lamp axis, one on top of the other; in this instance, in fact, the diaphragms equipped with filters are divided in sectors or panels, each one of 120 degrees.

As it will be easily noticed, the filters forming each one of the three sectors 12, 13 and 14; or 15, 16 and 17; or 18, 19 and 20, can be rotated on their own axis by means of a mechanical transmission mechanism 25-26 interconnecting them and a motor 11. Each sector has its own motor 11 operating independently from the others.

The dichroic filters in each sector 12, 13 and 14; or 15, 16 and 17; or 18, 19 and 20, can move simultaneously all together from a closed position, where they are able to totally intercept the light beam from the light source, to an open position where the light beam is not intercepted.

It may also be appreciated how at least a few degrees of light may pass without being filtered through the various sectors 12, 13 and 14; or 15, 16 and 17; or 18, 19 and 20 equipped with such filters, when they are in an intermediate position between the fully open position and the fully closed position; in these instances, the unfiltered light will join the filtered coloured light and obtain different saturation degrees of the resulting light, according to the rotation degree of the adjustable filters on their own axis.

As it will be noticed from FIG. 3, the filters pertaining to each sector of the filters diaphragm 8 are independent with respect to the filters of the other sectors forming the various diaphragms, and they may even have different colorations in the various sectors. In the latter instance, light beams of different colour may even be generated simultaneously.

In a most common case, the filters of the sector 12 may have a yellow colour, those of the sector 13 a magenta colour and those of the sector 13 a cyan colour; filter colorations are practically rotated by 120 degrees between a filters diaphragm 8 and the subsequent one 9 overlaying, so that in this diaphragm 9 the filters of the sector 15 may have a cyan colour, those of the sector 16 a yellow colour and those of the sector 17 a magenta colour; the position of the filters diaphragm 10 is rotated by further 120 degrees for the filters of the sector 18 to take the magenta colour, those of the sector 19 the cyan colour and those of the sector 20 the yellow colour.

Thus, in order to obtain one of the three basic colours, i.e. yellow, magenta and cyan, and fully intercept the light beam by giving it a colouring and a uniform wavelength, only one sector or panel of each diaphragm should remain in its closed position for intercepting the light beam emitted by the light source, i.e. leaving the other two sectors in their open position for free circulation of the air generated by a fan 2 located at the base of the equipment.

Figure 4:
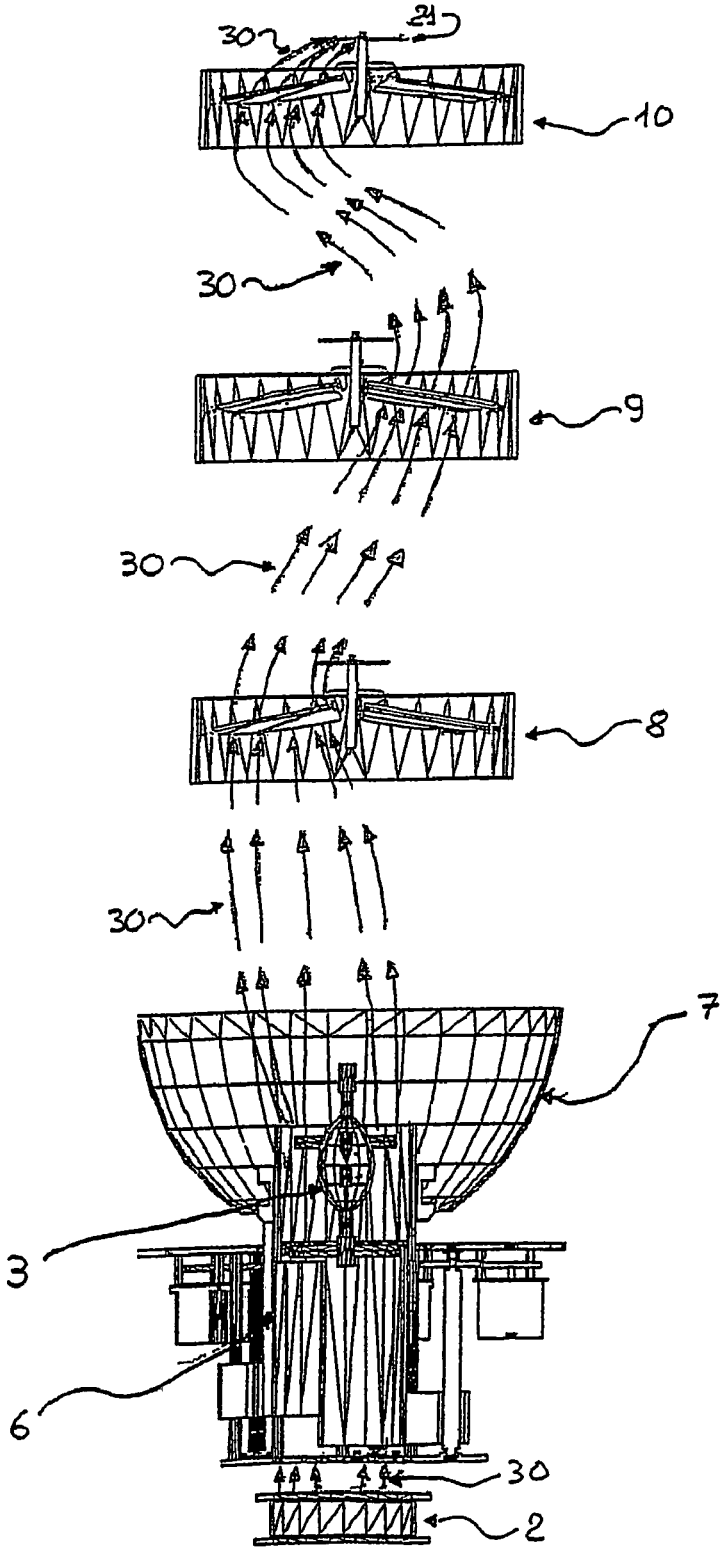
FIG. 4 shows a schematic section of the light beam projector, highlighting the directions of the air flow.

As it will be noticed from FIG. 4, the air generated by the fan 2 can freely flow in the space between the tubular wall 6 and the lamp 3, where a first significant cooling is operated, then it will rise and reach the first diaphragm 8 with flat filters, in which at least one of the sectors remains forcedly open all the time (if all the sectors of all flat filters diaphragms remain closed, the light beam would have a black coloration, which is not convenient and should never happen in the practice; moreover, the projector would have no ventilation), overcome it and flow over to the subsequent diaphragms 9 and 10 with flat filters, going through them the same way, finally flowing out of the equipment through a set of openings located in the anti-reverberation disk 21.

Figure 4A:
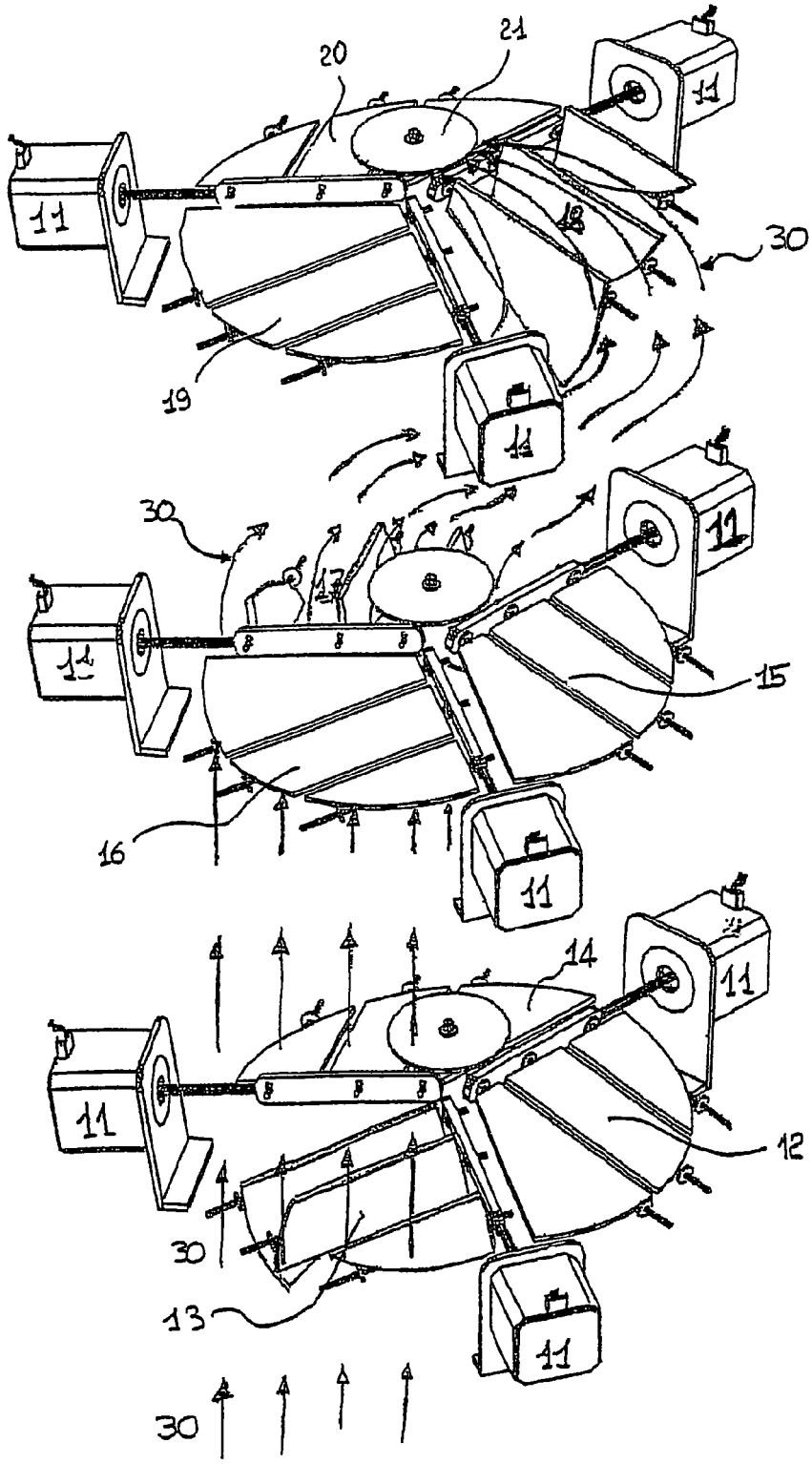
FIG. 4A shows a schematic section of the light beam projector according to the present invention.

FIG. 4*a* is representing a more detailed view of a possible solution of the present invention. In this figure, in fact, only one of the three sectors forming each diaphragm 8, 9 and 10 with flat dichroic filters remains in its open position (i.e. sectors 13, 17 and 18), so as not to intercept the light beam emitted by the light source and ensure free circulation of the air flow 30 generated by the fan 2. In this instance, coloration of the light beam being generated will be provided by the composition of two of the three basic or primary colours.

The air flow 30 will be able to freely circulate inside the equipment, cool down each internal component and then flow out of the equipment, finding no hindrances over its path from the fan 2 to the openings located on the anti-reverberation disk 21.

Obviously, different configurations can be provided in alternative to the one described for the position and number of adjustable dichroic filters in every sector of each diaphragm 8, 9 and 10, without departing from the novelty of the innovative idea of the present invention.

Figure 5:
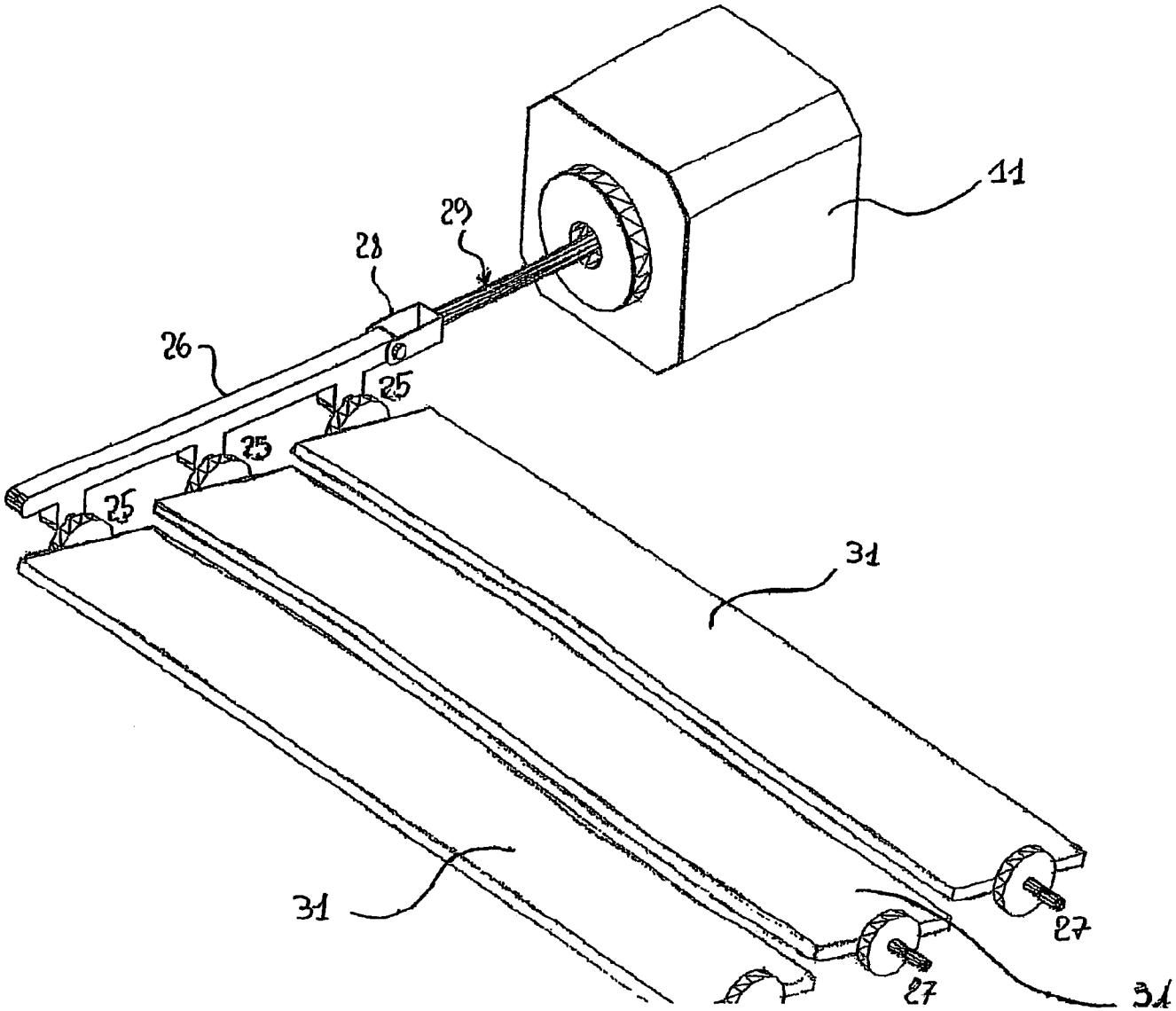
FIG. 5 shows a side view of a mechanism for rotating the flat dichroic filters in each sector of the flat filters diaphragm, according to the present invention.

FIG. 5 is representing a possible mechanical system, which may be used for rotating the dichroic filters 31 pertaining to one same sector on their own axis; each filter being connected on one end to a rotary mechanism 25 for receiving its own motion, and on the other end to a special support 27 fastening it to the diaphragm outer wall.

These rotary mechanisms 25 are interconnected through a connecting rod-crank system 26; an articulated joint 28 connects the connecting rod-crank system to the axis 29 of the linear motor 11.

Thus, rotation of the dichroic filters 31 is determined by the linear motion of the motor axis, being the latter controlled by a microprocessor with a special software (not described).

Alternative mechanical systems to the one described above for the motion of the dichroic filters 31 may also be manufactured using gear systems, e.g. a worm screw or a belt connected to a pulley, and any other common mechanisms known in the state of the art.

Also the number of flat filter sets according to the present invention may change: i.e. using only two sets of filters, each one with a determined number of sectors such to correct a coloured light beam through one or more tubular walls having one or more colour corrections on their surface.

From the above description the advantages of the present invention are clear.

In particular, free air circulation is provided inside the projector to avoid overheating of the components housed therein.

Moreover, since the sectors of the diaphragms with dichroic filters are not perpendicular to the light beam intercepted by them, all the heat reflected by the rays not flowing through the dichroic filters will be prevented from being sent back to the innermost side of the projector, adding to its overheating.

According to another advantage of the present invention, light beams of different colour shades can be generated thanks to differentiation of the basic colour and driving independence of the various filters forming the diaphragms interposed on the light beam path.

Moreover, a simultaneous use of the tubular wall surrounding the lamp and the diaphragms will ensure a more flexible generation of each desired coloured light beam, on one hand, and a simpler calibration of the desired final colour, on the other.

In the latter instance, a minor number of diaphragms with adjustable dichroic filters may also be utilized, while obtaining the same colour change capabilities and using less space in the vertical direction.

Finally, interlaying the tubular wall appropriately manufactured for absorbing a certain amount of colour temperature of the light generated by the lamp will produce light beams with a different colour temperature from the lamp generating them, so as to suitably adapt the projector for a different number of uses.

A dimmer effect can also be obtained on the light generated by the projector, interlaying the tubular wall made from opaque material or material with slits to a more or less extent on the light generated by the lamp.

Therefore, as it can be easily realized, the present invention is not merely restricted to the projector and its various components described above, but it can be subject to changes, improvement, replacement of equivalent parts and elements, without departing from the innovative idea of the present invention, as clearly detailed in the following claims.

A possible implementation is to provide the projector with an automatic equipment for setting the colour temperature generated by the projector itself. In this instance, the projector may be equipped with a closed loop control system of the colour temperature, in which a colour temperature sensor will detect the temperature of the light beam from the projector, compare it to a preset value and in case of a diverging result operate a motor-driven system to move the tubular wall 6 until the absorption of Kelvin degrees is such to produce a light beam with the desired colour temperature.

The invention claimed is:

1. A light beam projector comprising a light source and a reflecting means, which are so arranged to have the light generated by the light source converging into a light beam, said reflecting means having a hollow curved surface and a focal point located where the light source is positioned; filtering means of the light beam, being able to change the colour of said light beam based on the angle of incidence of the beam on said filtering means, said filtering means comprising a plurality of filters arranged by sectors to form a diaphragm interposing between said light source and the light beam outlet from the projector, where in order to change the angle of incidence of the light beam on said filters, said sectors rotate on their own axis, to move from a closed position, in which they fully intercept the light beam, to an open position, in which they do not intercept such a light beam, as well as to all intermediate positions; wherein said light beam projector provides at least two filtering systems; one of them comprising at least one of said diaphragms, placed one after the other along the path of the light beam, and that each sector forming said diaphragms rotated independently from the position of the other one or other remaining sectors.

2. A light beam projector according to claim 1, wherein said two filtering systems are two diaphragms.

3. A light beam projector according to claim 1, further comprising actuating means of said sectors, which are so controlled to let at least one of the sectors pertaining to each diaphragm remain in its open position, forming a ventilation path inside the projector.

4. A light beam projector according to claim 3, wherein each sector pertaining to the same diaphragm has a different basic coloration with respect to the coloration of the other sector or other remaining sectors.

5. A light beam projector according to claim 4, wherein said sectors of a diaphragm face the sectors of the subsequent diaphragm, being substantially overlapping, and the basic coloration of a sector pertaining to a diaphragm differs from the basic coloration of the sector pertaining to the facing overlapping diaphragm.

6. A light beam projector according to claim 1, wherein the number of sectors forming said diaphragms equals the number of diaphragms in the light beam projector.

7. A light beam projector according to claim 6, wherein said number of sectors and diaphragms equals three.

8. A light beam projector according to claim 1, wherein each one of said sectors comprises a plurality of filtering elements, which are mechanically connected to each other.

9. A light beam projector according to claim 8, wherein independent rotation of each said sectors is obtained through rotation of one same angle of each said filtering elements forming the sector.

10. A light beam projector according to claim 9, further comprising special mechanisms, which produce simultaneous rotation of one same angle of said filtering elements pertaining to the same sector.

11. A light beam projector according to claim 10, wherein said special mechanism comprises a motor and a system for converting its linear motion into a rotary motion.

12. A light beam projector according to claim 8, wherein said filtering elements have a substantially flat surface.

13. A light beam projector according to claim 8, wherein said filtering elements have a rotation axis taking a traverse position to the vertical axis of the projector.

14. A light beam projector according to claim 13, wherein rotation of said filtering elements is supported, on one hand, by supporting means extending in a radial direction inside said diaphragms and, on the other hand, by seats obtained in the frame of the diaphragm itself.

15. A light beam projector according to claim 8, wherein said filtering elements are dichroic filters.

16. A light beam projector according to claim 8, wherein said filtering elements have a different basic coloration between the various filtering elements forming the same sector of said diaphragm.

17. A light beam projector according to claim 16, wherein said filters rotating on their own axis differ in each sector, in order to change coloration of the light beam intercepted by them.

18. A light beam projector according to claim 1, wherein said sectors are laying on planes inclined with respect to the axis of the light beam when said plurality of filters is in said closed position.

19. A light beam projector according to claim 1, further comprising at least a tubular wall, which is so positioned to embrace the light source laterally and intercept the light before it reaches the reflecting means, and means suitable for causing such tubular wall to move axially from an operating position, in which it embraces the light source laterally, to a rest position located away from the reflecting means, in which it does not interfere with the radiations emitted by the light source and to all possible intermediate positions, wherein said tubular wall can be arranged.

20. A light beam projector according to claim 19, wherein the surface of said tubular wall undergoes a treatment for obtaining a particular frosted diffused light effect when positioned for intercepting the light beam, and such a wall is able to move from an operating position to a rest position and to all possible intermediate positions.

21. A light beam projector according to claim 20, wherein the surface of said tubular wall is treated to different "frosting" degrees, in order to obtain a light beam photometry, which may change according to the portion of it being interposed between the light source and the reflecting means.

22. A light beam projector according to claim 19, wherein said tubular wall is made from a material being able to fully intercept the radiations produced by the light source, so it can be utilized as a shutter.

23. A light beam projector according to claim 19, wherein said tubular wall, made from a material being able to totally intercept the radiations produced by the light source, has anyway some open portions on its surface and can operate like a mechanical dimmer by changing its portion so arranged for intercepting the light emitted by the light source, letting either a minor or major light amount flow through according to its position around the light source.

24. A light beam projector according to claim 19, wherein said tubular wall, made from a varying opaque material according to its various portions in the vertical direction, operates like a dimmer and will allow either a major or minor brightness of the light beam according to which portion of the tubular wall is interposed between the light source and the reflecting means.

25. A light beam projector according to claim 19, wherein said tubular wall is made from a material being able to attenuate specified ranges of colour temperature Kelvin degrees.

26. A light beam projector according to claim 25, wherein said tubular wall is formed in the vertical direction by different portions of materials being able to attenuate ranges of colour temperature Kelvin degrees, for obtaining various colour temperature degrees according to the position of said wall, maintaining the same light source all the time.

27. A light beam projector according to claim 26, wherein said tubular wall pertains to an automatic colour temperature detection system of the light beam generated by the projector, including in particular a colour temperature sensor of the light beam being generated, comparing means, control means and servomotor means.

28. A light beam projector according to claim 19, wherein said tubular wall is formed by a dichroic filter which has undergone a dichroic treatment for obtaining several colorations in a vertical direction of said tubular wall, so as to change the colour of the light emitted by the light source according to what portion of said dichroic filter, is interposed between said light source and said reflecting means in the vertical direction.

29. A light beam projector according to claim 19, further comprising a plurality of said tubular walls placed coaxially at a short distance one inside the other, each one provided for different aims, and being so arranged to have each one moving independently from the others.

30. A light beam projector according to claim 19, wherein said means for moving the tubular wall axially are positioned to have the supports bearing the respective tubular walls moving vertically.

31. A light beam projector according to claim 19, wherein said tubular wall is made from a material being able to fully intercept the radiations produced by the light source and can be utilized as a shutter.

32. A light beam projector comprising a light source and a reflecting means, which are so arranged to direct the light generated by the light source into a light beam; one or more tubular walls so positioned for embracing the light source laterally and intercept the light before it reaches the reflecting means; suitable means for moving said tubular walls axially from an operating position, in which they embrace the light source sideways, to a rest position under the reflecting means, in which they do not interfere with the radiations emitted by the light source, and to all possible intermediate positions of said tubular walls; said diaphragms comprising one or more diaphragms having a plurality of sectors, and each sector comprises one or more filters; said mechanisms being designed to let the filters pertaining to each said sector rotate independently from the filters of the other sectors; said filters rotating on their own axes and forming the various sectors being substantially not in the plane perpendicular to the axis of the light beam generated by the system formed by the light source and reflecting means.

33. A light beam projector according to claim 32, wherein the axis of said rotary filters is so arranged to intersect their rotating mechanism, said mechanism being arranged nearly radial to the light beam.

34. A light beam projector comprising a light source and a reflecting means which are so arranged to have the light generated by the light source converging into a light beam, said reflecting means having a hollow curved surface and a focal point located where the light source is positioned; filtering means of the light beam able to change the colour of said light beam based on the angle of incidence of the beam on said filtering means, said filtering means comprising a plurality of filters arranged by sectors to form a diaphragm interposed between said light source and the light beam outlet from the projector, wherein in order to change the angle of incidence of the light beam on said filters, said sectors are able to rotate on their own axes, to move from a closed position, in which they fully intercept the light beam, to an open position, in which they do not intercept the light beam, as well as to all intermediate positions; wherein the sectors of said filtering means have different degrees of opacity so as to operate like a mechanical dimmer and allow either a major or minor brightness of the light beam, according to the filters sector being placed for intercepting the light beam emitted by the light source.

35. A light beam projector according to claim 34, wherein said filtering means further comprises a tubular wall, which is axially movable for setting which filters sector is so placed for intercepting the light beam emitted by the light source.

36. A light beam projector comprising a light source and a reflecting means, which are so arranged to have the light generated by the light source converging into a light beam, said reflecting means having a hollow curved surface and a focal point located exactly where the light source is positioned; filtering means of the light beam for changing the colour of said light beam based on the angle of incidence of the beam on said filtering means, said filtering means comprising a plurality of filters arranged by sectors to form a diaphragm interposed between said light source and the light beam outlet from the projector, wherein in order to change the angle of incidence of the light beam on said filters, said sectors rotate on their own axes, to move from a closed position, in which they fully intercept the light beam, to an open position, in which they do not intercept the light beam, as well as to all intermediate positions; wherein said filtering means comprise different materials able to attenuate different colour temperature ranges, so as to have different colour temperature radiations according to the position of the sectors forming the filtering means, maintaining the same light source all the time.

37. A light beam projector according to claim 36, wherein said filtering means further comprise a tubular wall of material having different degrees of opacity, said tubular wall being axially movable for setting the position of the sectors forming the filtering means.

38. A light beam projector comprising a light source and a reflecting means, which are so arranged to have the light generated by the light source converging into a light beam, said reflecting means having a hollow curved surface and a focal point located where the light source is positioned; filtering means of the light beam, for changing the colour of said light beam based on the angle of incidence of the beam on said filtering means, said filtering means comprising a plurality of filters arranged by sectors to form a diaphragm interposing between said source of light and the light beam outlet from the projector, where in order to change the angle of incidence of the light beam on said filters, said sectors rotate on their own axis, so as to move from a closed position, in which they fully intercept the light beam, to an open position, in which they do not intercept said light beam, as well as to all intermediate positions, and that said filtering elements have a rotation axis in a traverse position to the projector vertical axis, further comprising a plurality of flat filters divided in sectors, each one of them provided for obtaining different aims, and being so arranged to be moved each one independently from the others.

39. A light beam projector according to claim 38, wherein said filtering elements are moved independently for delimiting a ventilation air flow path of said projector.

* * * * *